US005784941A

United States Patent [19]

Sanborn

[11] Patent Number: 5,784,941

[45] Date of Patent: Jul. 28, 1998

[54] PORTABLE SAWMILL

[76] Inventor: Howard Sanford Sanborn, P.O. Box 2059, Darien, Ga. 31305

[21] Appl. No.: 742,208

[22] Filed: Oct. 31, 1996

[51] Int. Cl.[6] ..... B27B 3/26

[52] U.S. Cl. ..... 83/794; 83/795; 83/471.2

[58] Field of Search ..... 83/400, 399, 794, 83/797, 409, 452, 471.2, 522.11, 522.13, 802, 811, 788, 578, 795

[56] References Cited

U.S. PATENT DOCUMENTS

| | | | |
|---|---|---|---|
| 3,115,909 | 12/1963 | McManama | 83/794 |
| 3,225,799 | 12/1965 | Hayden et al. | 83/794 |
| 3,628,496 | 12/1971 | Schmitt | 83/471.2 |
| 3,695,316 | 10/1972 | Pluckhahn . | |
| 3,721,146 | 3/1973 | McManama | 83/471.2 |
| 3,747,457 | 7/1973 | Thompson | 83/471.2 |
| 3,926,086 | 12/1975 | Crane . | |
| 4,177,704 | 12/1979 | Randle | 83/409 |
| 4,235,140 | 11/1980 | Reece . | |
| 4,300,428 | 11/1981 | Woodland | 83/794 |
| 4,307,641 | 12/1981 | Shapleigh . | |
| 4,559,858 | 12/1985 | Laskowski et al. | 83/794 |
| 4,589,320 | 5/1986 | Kaster . | |
| 4,640,170 | 2/1987 | Bakken . | |
| 4,715,255 | 12/1987 | Harriman | 83/471.2 |
| 4,987,812 | 1/1991 | Benavidez | 83/522.11 |
| 5,036,738 | 8/1991 | May | 83/471.2 |
| 5,103,710 | 4/1992 | Ross | 83/522.11 |
| 5,203,247 | 4/1993 | D'Arcy . | |
| 5,320,016 | 6/1994 | Spath et al. . | |

FOREIGN PATENT DOCUMENTS

| | | | |
|---|---|---|---|
| 26966 | 4/1954 | Finland | 83/522.11 |
| 2 450 676 | 11/1980 | France . | |
| 207400 | 3/1908 | Germany | 83/522.13 |
| 52-34494 | 3/1977 | Japan . | |
| 23078 | 3/1913 | Norway . | |
| 729046 | 4/1980 | U.S.S.R. . | |

*Primary Examiner*—Maurina T. Rachuba
*Attorney, Agent, or Firm*—Richard C. Litman

[57] ABSTRACT

The invention relates to a portable sawmill, in which the functions of adjusting a cut, and of making a cut, are divided between two separate devices, instead of combined in one device. The sawmill utilizes a chainsaw that is clamped to a carriage which is movably attached to an alignable monorail track. Attached to the track is a system of sprockets and a chain operated by a crank which moves the carriage back and forth on the track. Attached to the carriage is a throttle actuator that, in conjunction with the chain, operates the throttle of the chainsaw, so that the motor of the chainsaw is at full power when cutting, but returns to idle when not cutting. With the addition of a spacer to give clearance for the wheels of the carriage, the foregoing device can be attached to any suitable support, and then a log can be placed and held in position, and lumber cut from it. A suitable support can be the frame specifically designed for the invention, or the edge of a flat platform, such as a loading dock.

1 Claim, 9 Drawing Sheets

PORTABLE SAWMILL

BACKGROUND OF THE INVENTION

1. Field of the Invention

The present invention relates to a portable sawmill having a cutting mechanism for sawing lumber supported by a frame, which may be operated by one or more persons, and can be towed by an automobile or truck to a site where it is used.

2. Description of the Prior Art

While there are prior inventions for portable sawmills, none are equivalent to the present invention in separating the function of adjusting the cut, and the function of making the cut, with a separate device for each function. All the portable sawmills of the prior art perform the two functions with a single device, having the adjustment means, i.e. setworks, operatively interposed between the carriage and the chainsaw. The orientation of the chainsaw with the chainsaw up and vertical is another difference between the present invention and the prior art, as is the capability of the present portable sawmill to be mounted on uneven surfaces.

By separating the functions, the cutting means can be made simpler, stronger, and more economically. Accuracy of the cut is improved by the elimination of the setworks between the carriage and the saw, allowing the saw to be clamped directly to the carriage, thus avoiding distortion caused by the setworks. The distortion from the setworks can be quite large, and depends on how far the force, exerted on the carriage to make the saw move, has to travel before it actually reaches the saw itself, and on how much tolerance is in the interconnected parts of the setworks themselves.

The function of adjusting the cut can be performed by setworks, or by maneuvering the log into a stable position by hand and holding it there by log dogs. The chainsaw is orientated up and vertically. The possible length of the sawbar is limited only by overhead obstructions. No adjustments to the sawmill are required to accommodate different lengths of sawbars. Having the chainsaw orientated upward ("bar up") is preferable to having it orientated downward ("bar down"). For instance, if a bar down sawmill is cutting a ten inch log, it will use the top ten inches of the sawbar. The present invention, being a bar up sawmill, will use the base ten inches of the sawbar. The base vibrates and wanders less from a straight path when cutting, as it is closer to the sawbar's clamp than the tip. This significantly increases the accuracy of cutting, and reduces defects such as "scoring" caused by a vibrating sawbar. Processing a rough board to a finished commercial size can often result in thirty percent waste. Any reduction in defects or increase in accuracy is proportionately rewarded with economic and ecological benefits. Regardless of whether the saw is bar up or bar down, any orientation of the bar other than vertical introduces the problem of the weight of the board being cut, pinching the cutting chain of the saw, with the pinching being most severe in a horizontal orientation. This pinching produces defects such as scoring, uneven and excessive wear of the bar and chain which reduces accuracy in cutting, and excessive wear on the chainsaw motor. The pinching effect also tends to pull the following, non-cutting edge of the cutting chain out of its guide groove in the sawbar. As the leading, cutting edge of the chain exits the log, the full weight of the board rests on the backside of the chain. Operator safety is at its lowest, while the speed of the chain, fully exposed and being pulled out of its guide, is at its highest.

The present invention can be releasably attachable to uneven surfaces, on which it can be precisely aligned by the addition of shims. The alignment is maintainable over the lifetime of the sawmill.

The frame of the sawmill provides adequate support for a log while it is being cut. A problem common to any prior art that supports the log by its ends, but provides no support in between, is that as the workpiece is processed and boards are cut free, the center of the workpiece increasingly sags as more material is removed from the workpiece. In fact, the workpiece typically sags as the cut is being made because the stiffness provided to the workpiece by the board being cut is gradually removed as the cut progresses. In such a case, even if the prior art is capable of sawing in a straight line in one plane, it is incapable of producing a flat board with the same thickness in the center as at the ends.

U.S. Pat. No. 3,695,316, issued to Patrick J. Pluckhahn, on Oct. 3, 1972, discloses a portable timber milling jig, in which the log is fixed in place, while a saw carriage moves on a rail over the log. The instant invention is distinguishable in that it allows the position of the log to be adjusted.

U.S. Pat. No. 3,926,086, issued to Paul R. Crane, on Dec. 16, 1975, discloses a portable saw mill, in which the position of the saw, but not of the log, is adjustable.

U.S. Pat. No. 4,235,140, issued to Daniel R. Reece, on Nov. 25, 1980, discloses a portable saw mill, having separable sections clamped to ground bearing cross members to which a log to be ripped is dogged. The instant invention is distinguishable in that the saw cuts the log from underneath rather than from above, thus reducing any tendency of pinching of the log on the saw and, as a consequence, improving accuracy of cutting.

U.S. Pat. No. 4,307,641, issued to Robert Shapleigh, on Dec. 29, 1981, discloses a portable sawmill comprising two parallel guide rails attached to two end frames which are attached to two skid members. Again, the instant invention is distinguishable in that the saw cuts the log from underneath rather than from above.

U.S. Pat. No. 4,589,320, issued to Paul G. Kaster, on May 20, 1986, discloses a log lifting and support apparatus, by which a log may be raised in a vertical direction only.

U.S. Pat. No. 4,640,170, issued to John A. Bakken, on Feb. 3, 1987, discloses a chain saw carriage, which includes a frame which fits over a log to be cut.

U.S. Pat. No. 5,203,247, issued to John W. D'Arcy, on Apr. 20, 1993, discloses a vertical mitering band saw, by which the position of the saw, rather than of the lumber to be cut, is adjusted.

U.S. Pat. No. 5,320,016, issued to Dieter Spath and Armin Stolzer, on Jun. 14, 1994, discloses a vertical band saw, with a carrier that is pivotable about a vertical axis of rotation, and can also tilt about a horizontal axis.

Norwegian Patent No. 23,078, dated March 1913, discloses a motorized chain saw supported by a crane.

Japanese Patent No. 52-34494, dated March 1977, discloses a device for feeding material into a cutting machine, which uses rollers to move and stabilize the material to be cut.

Soviet Patent No. 729046, dated April 1980, discloses a transverse cross-cut saw for cutting several logs at one time, with one end of the saw hinged and sprung in a frame slot, with a plate which trips a limit switch mounted on the frame.

French Patent No. 2 450 676, dated November 1980, discloses equipment for sawing logs into quarters, having a vertically movable band saw, and a longitudinally, transversely, and rotationally movable log handling trolley.

None of the above inventions and patents, taken either singly or in combination, is seen to describe the instant invention as claimed, as they do not describe an easily aligned track wherein the carriage can function self-sufficiently, without the setworks, to cut lumber.

SUMMARY OF THE INVENTION

The invention relates to a portable sawmill, in which the functions of adjusting a cut, and of making a cut, are divided between two separate devices, instead of combined in one device. The sawmill of the present invention utilizes a chainsaw that is clamped to a carriage which is movably attached to an alignable monorail track. Attached to the track is a system of sprockets and a chain operated by a crank which moves the carriage back and forth on the track. Attached to the carriage is a throttle actuator that, in conjunction with the chain, operates the throttle of the chainsaw, so that the motor of the chainsaw is at full power when cutting, but returns to idle when not cutting. With the addition of a spacer to give clearance for the wheels of the carriage, the foregoing device can be attached to any suitable support, and then a log can be placed and held in position, and lumber cut from it. A suitable support can be the frame specifically designed for the invention, or the edge of a flat platform, such as a loading dock.

Accordingly, it is a principal object of the invention to provide a portable sawmill that may be easily transported to a location where it is needed for use by an individual person.

It is another object of the invention to provide a portable sawmill that can more accurately cut logs, so that they will be suitable as lumber with a minimum of wastage from planing, to and through smoothing.

It is a further object of the invention to provide a new and improved method of cutting logs by adjusting the position of the log to be cut.

Still another object of the invention is to provide new and improved means of moving a saw while it is cutting logs.

Still a further object of the invention is to provide a means to automatically operate the throttle of a chainsaw used on the sawmill.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
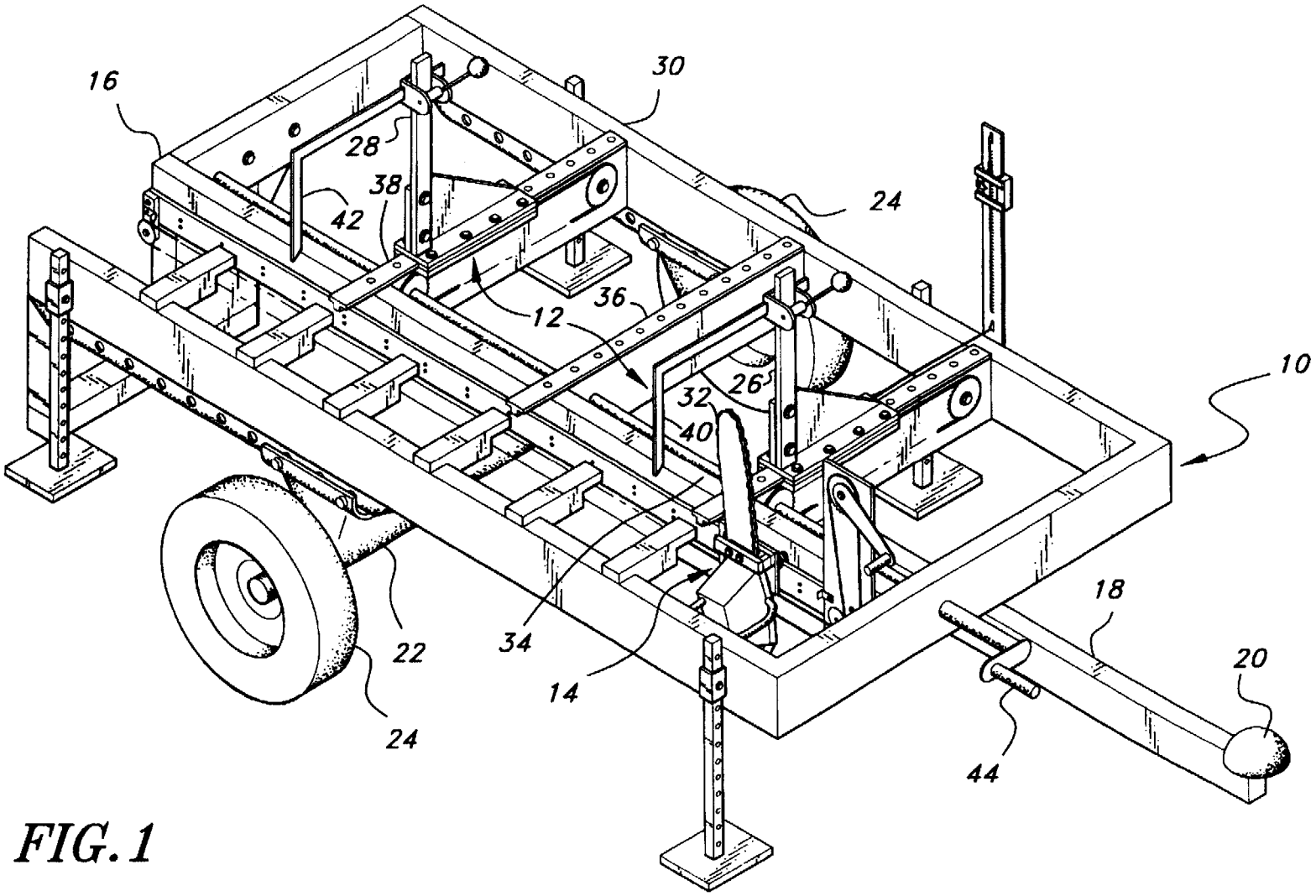
FIG. 1 is a perspective view of a portable sawmill utilizing the invention.

The present invention is a portable sawmill by which the position of a log to be cut into lumber can be adjusted. FIG. 1, gives a perspective view of a portable sawmill utilizing the present invention. Referring to FIG. 1, the preferred embodiment's basic components can be seen to comprise the frame 10, the setworks 12, and the cutting means 14. The setworks are attached to the top of the frame, and are what perform the adjustment function, holding the log and positioning it where desired in the line of cut, preparatory to cutting. The cutting means 14 are attached to the side of the middle beam 16 of the frame shown, or any other suitable structure or member. The operational sawmill can be transported on a truck or trailer, or a tongue 18, hitch 20, axle 22, and wheels 24, can be used to facilitate mobility.

In using the preferred embodiment of the invention, the headstocks 26 and 28 are moved toward left side beam 30 to provide room for the log to be cut, between the sawbar 32 and the headstocks. The log is placed on setworks tracks 34, 36 and 38, and held at each headstock by dogs 40 and 42. The log is advanced into the line of cut by rotation of crank 44. The setworks 12 have been developed over the last century and are very efficient, allowing easy access to the log by cant hooks (not shown) by which the log can be rotated. The headstocks confine the action of the log to "spinning" in place, thereby avoiding the effort of pushing the log back into position after rotation.

Figure 2:
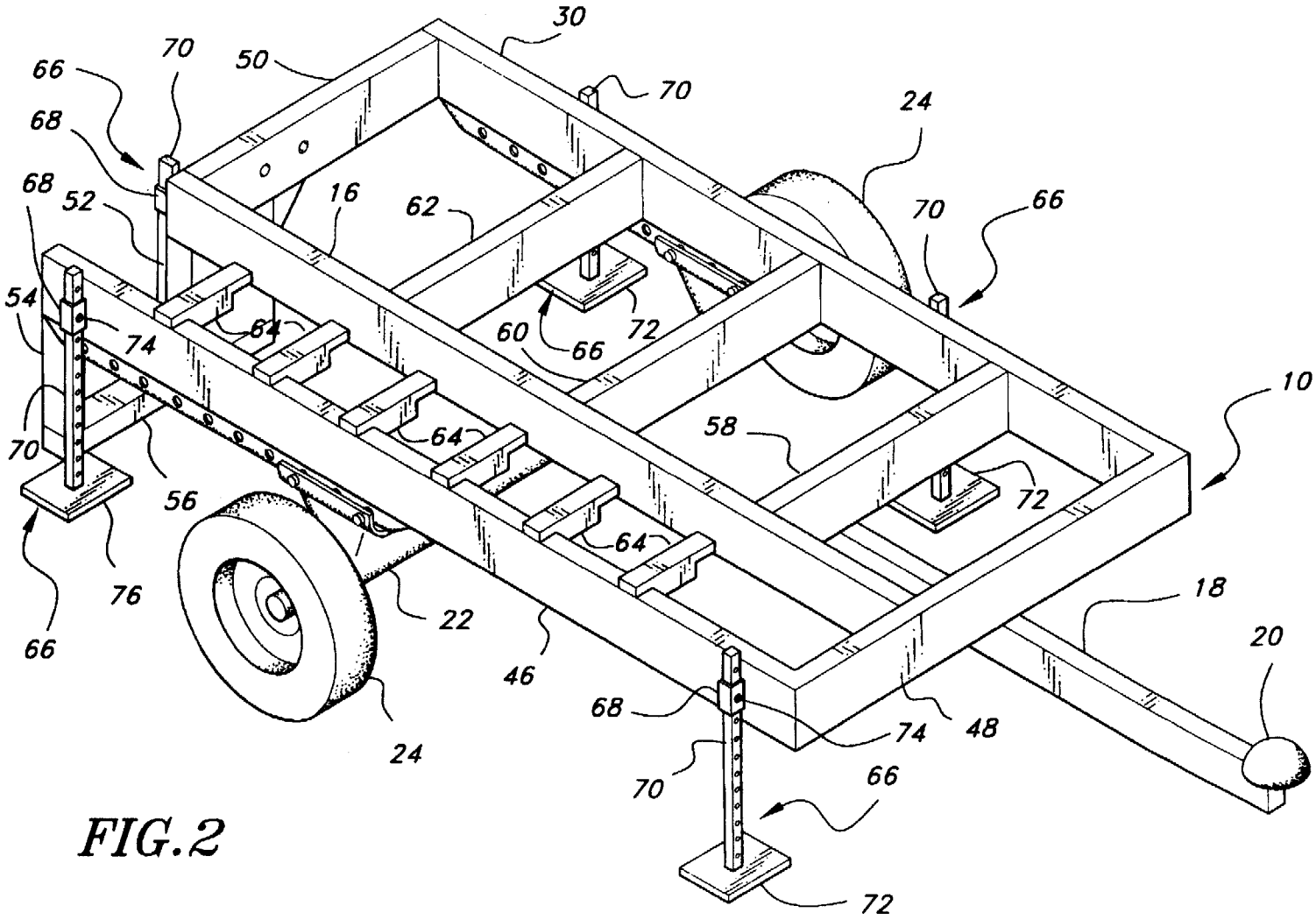
FIG. 2 is a perspective view of the frame of the invention.

Referring to FIG. 2, the frame of the sawmill includes a left side beam 30, a right side beam 46, and a middle beam 16, positioned off center between the two side beams. A front crosspiece 48 and a back crosspiece 50 are attached to the ends of the beams to hold the frame together in one horizontal plane. The back crosspiece 50 is shorter than the front crosspiece 48, as the front crosspiece extends from the left side beam 30 to the right side beam 46, while the back crosspiece extends from the left side beam 30 to only the middle beam 16. The attached vertical frame members 52 and 54 and horizontal frame member 56 serve to support the back end of the right side and middle beams and also to form an opening in the frame for the cutting means 14 to travel onto sawmill extensions. (The sawmill extensions are not shown in the drawings.) Alternatively, if no extensions are planned, back crosspiece 50 can be made of equal length to front crosspiece 48. Middle crosspieces 58, 60 and 62 are attached between beams 16 and 30 to strengthen the frame, support the log, and provide a mounting for the setworks. A plurality of interrupted crosspieces 64 are attached to the inside of beam 46. They provide an opening for the line of cut and form a board deck, which supports a board while it is being cut, and after it is cut keeps it from falling on the ground. The tops of the interrupted crosspieces 64 are in a plane with the log supports, which in the preferred embodiment are the tops of the setworks tracks, hence the difference in height between the interrupted crosspieces and the rest of the frame.

A plurality of supports 66 support the sawmill in use and are adjustable to compensate for variances in the ground level. They consist of tubes 68 attached to the frame, through which vertical supports 70 slide. Pads 72 are attached to the bottom ends of the vertical supports to distribute the load placed on the support. Each support is clamped into position by tightening a bolt 74 in a threaded hole in the tube.

Figure 3:
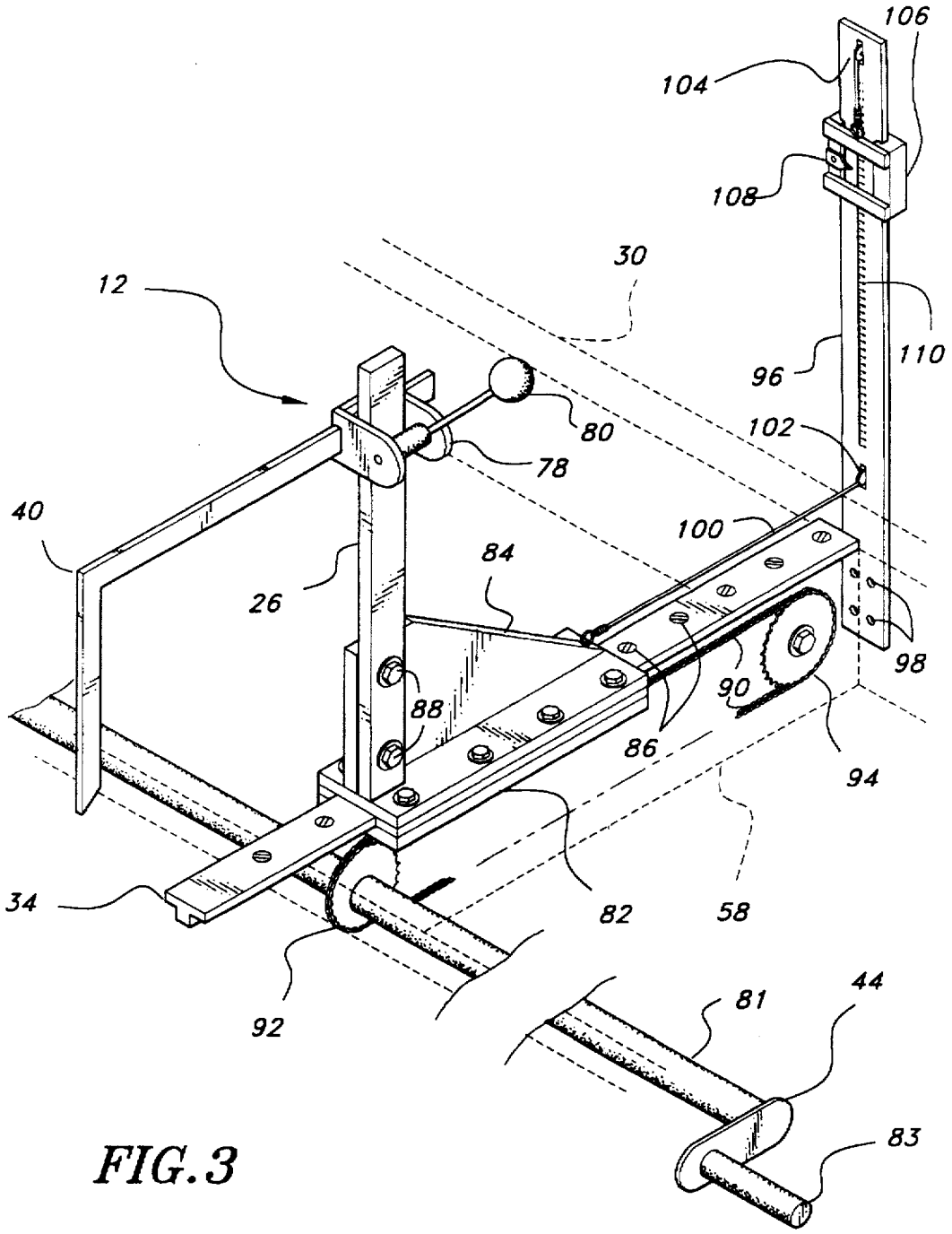
FIG. 3 is a perspective detail view of part of the setworks.

FIG. 3 shows one of the two or more setworks 12 for holding the log while it is being cut. Each setwork 12 has a headstock 26, and a dog 40, which are joined by a clamp 78. There is a lever 80, which when it is pushed down actuates the clamp to hold the dog in place, and when it is pulled up releases the clamp so that the dog can slide up and down or in and out on the headstock, to adjust the vertical and horizontal position of the dog to fit the size of the log being cut. There is also a crank 44, with a shaft 81, which can be turned manually by a handle 83 to adjust the horizontal position of both of the dogs simultaneously, so as to enable parallel cuts to be made in the log. The headstock slides horizontally on a setworks track 34, which is contacted by a base member 82 of the headstock. The base member has a trapezoidal projection 84. The setworks track is secured on the middle crosspiece 58 by screws 86. The headstock is fastened to the trapezoidal projection of the base member by bolts 88. The headstock is moved by a first chain with rollers 90, which is connected to the bottom of the base member (not shown). The chain with rollers is retained on a forward wheel with sprockets 92 attached to the shaft 81, and a rear wheel with sprockets 94 attached to the crosspiece. A ruler 96 is attached to the left side beam 30 by bolts 98. A line 100 is attached to the base member, retained on a lower wheel 102, runs behind the ruler, and is retained on a upper wheel 104, from which it descends to hold a sliding member 106 having a pointer 108 which indicates the horizontal position of the dogs on a scale 110 engraved or painted on the ruler.

Figure 4:
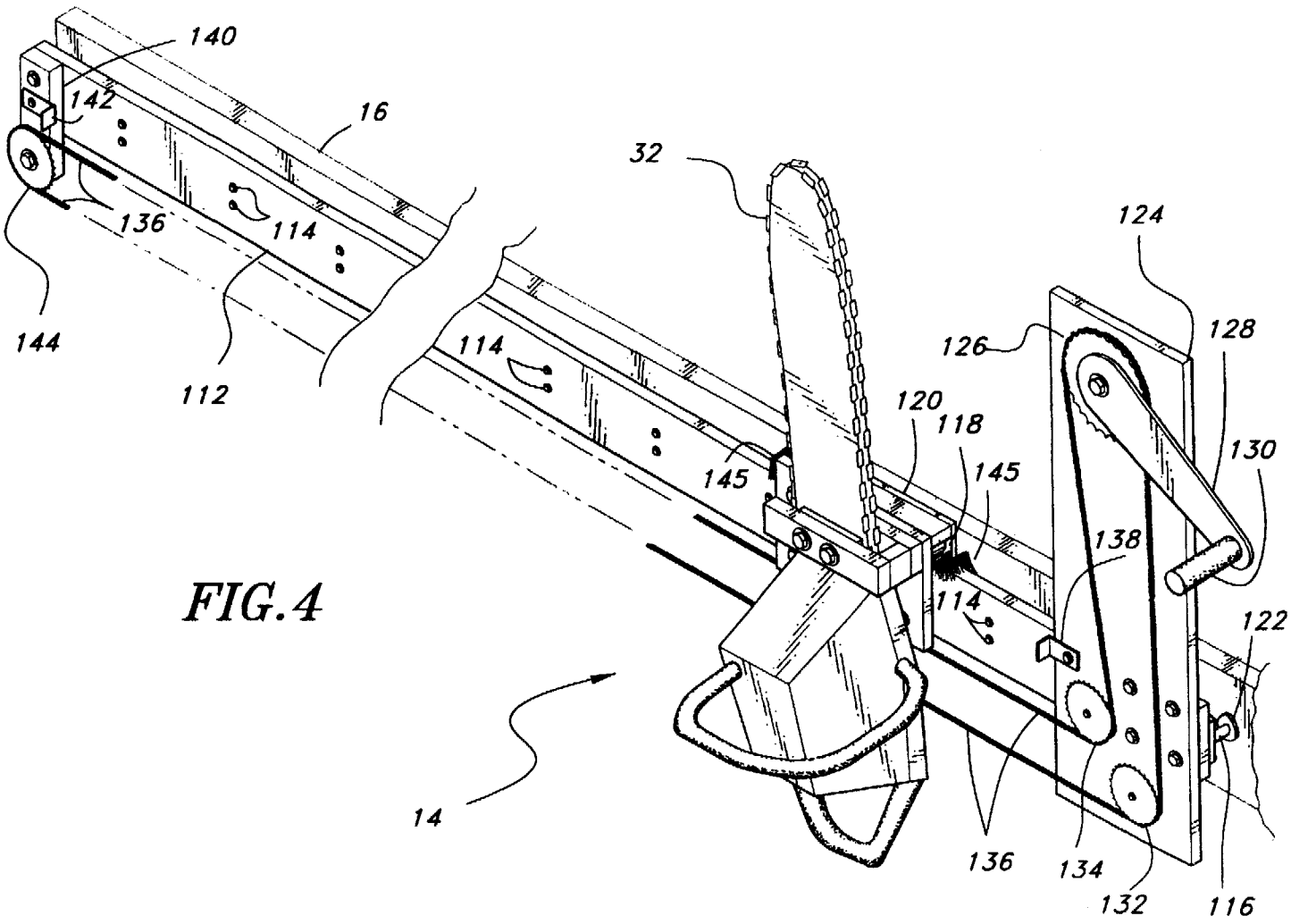
FIG. 4 is a perspective view of the invention, without the frame and setworks.

Referring now to FIG. 4, in the preferred embodiment the monorail track 112 is removably attached to middle beam 16, or any other suitable support or member, by bolts 114. On the bolts, between the track and the frame or other support, are spacers 116 (only one of which is shown) which provide clearance between the track and the frame for the shouldered wheels 118 of the carriage 120 to pass through. Each pair of bolts 114 must be spaced close enough to each other vertically to allow the shoulders of the wheels 118 to pass on both the top and bottom edges of the track, and be spaced close enough to other pairs of bolts horizontally to adequately support the track. The use of shims 122 (only one of which is shown) in conjunction with the spacers allows the track to be precisely alignable and easily adaptable to uneven surfaces such as the edge of a loading dock. There may be either a single or double row of spacers and shims. The ability to align the track, combined with the elimination of setworks between the carriage and chainsaw, allow the saw to be precisely guided along the line of cut. Attached to the front end of the track is a post 124 which supports a portion of the means for moving the carriage. At the top end of the post is a drive sprocket 126, driven by a crank 128, which has a rotatable handle 130, the sprocket and crank being suitably journalled, and attached to the post so as to be freely rotatable. At the bottom end of the post are a front idler sprocket 132 and a middle idler sprocket 134, both of which are suitably journalled, and attached to the post so as to be freely rotatable, with at least one of them being adjustably attached so as to be able to take up slack in chain 136 if needed. An elongated attachment opening (not shown, as hidden behind one of the wheels) in the post enables the necessary adjustment to be made. A front carriage stop 138 is also attached to the post, and serves to limit the travel of the carriage to prevent damage to the cutting means. At the back end of the track a smaller, rear post 140 is attached, to which a back carriage stop 142 and a back idler sprocket 144 are attached, sprocket 144 being suitably journalled and freely rotatable. One end of chain 136 is attached to the front end of the carriage by a first clevis (not shown), then runs horizontally under and around middle idler sprocket 134, vertically up and around drive sprocket 126, vertically down and around front idler sprocket 132, horizontally beneath the carriage the length of the track, and under and around back idler sprocket 144, and then is attached to the back end of the carriage by a second clevis (not shown). As can be seen best in the drawing, when crank 128 is rotated in one direction, carriage 120 is caused to move in one direction on track 112, and the carriage moves in the opposite direction when the crank is oppositely rotated. By this means the carriage and the saw are moved along the line of cut. Brushes 145 on the front and rear of the carriage keep the track free of saw dust, so that the movement of the saw and carriage is not impeded.

Figure 5:
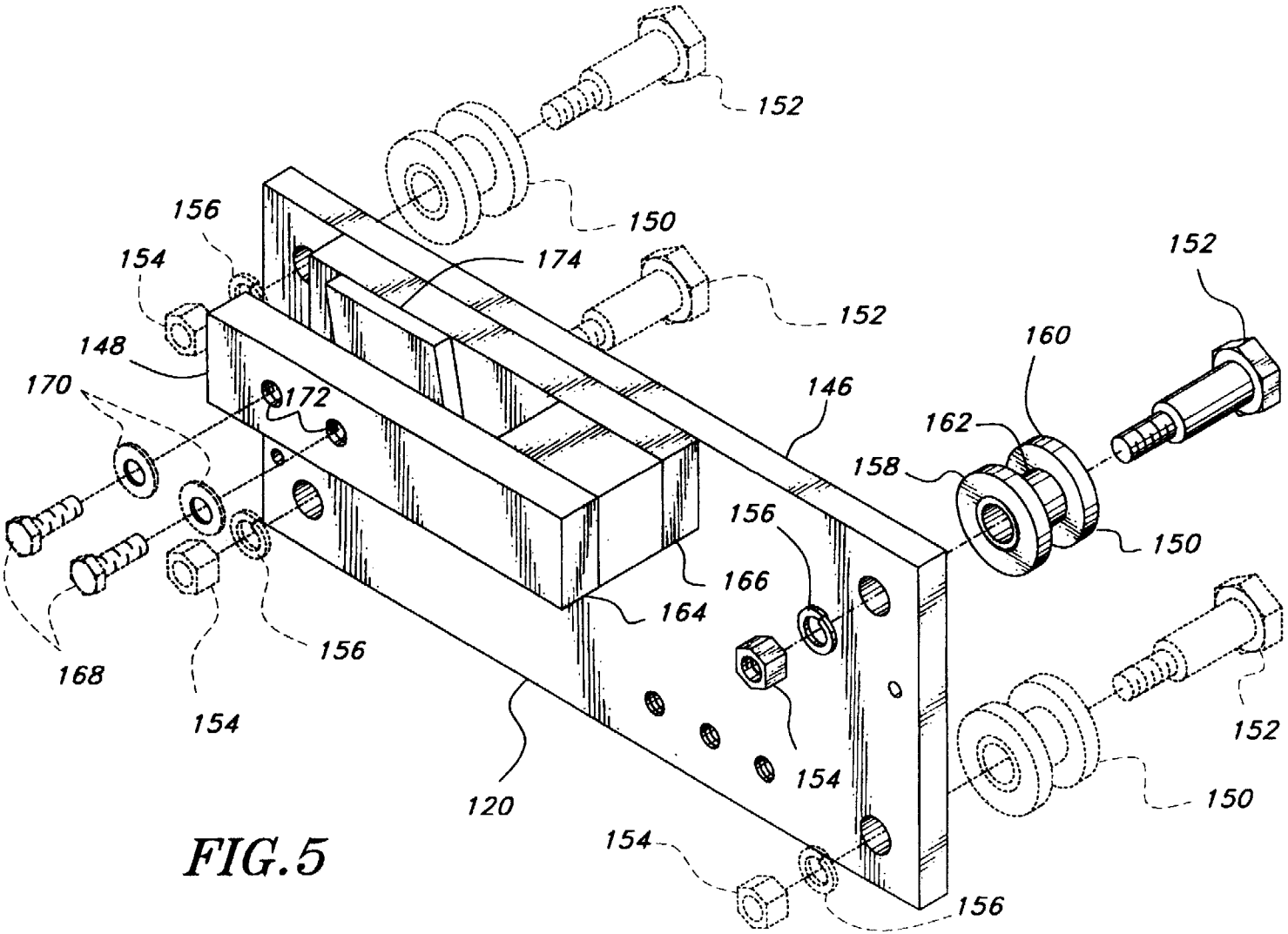
FIG. 5 is an exploded perspective detail view of the carriage without the chainsaw.

Referring to FIG. 5, the carriage 120 can be seen to consist of a carriage plate 146 which supports a bar clamp 148 on the near side, and shouldered wheels 150 on the far side. Also shown are bolts 152 by which the shouldered wheels are retained on the carriage plate, and nuts 154, with washers 156, that retain the ends of the bolts on the opposite side of the carriage plate. Each shouldered wheel has an inner shoulder 158, an outer shoulder 160, and a groove 162 within which the monorail track 112 shown in FIG. 4 fits. The bar clamp 148 is a U-shaped member with an outer horizontal jaw 164, and an inner horizontal jaw 166, between which a sawbar is removably clamped, far enough away from the carriage plate to provide clearance for the chainsaw engine. Bolts 168, with optional washers 170, are inserted through threaded holes 172 in the outer jaw of the bar clamp. A clamp pad 174, attached to the inside of a first jaw 166, provides clearance for the cutting chain. The pad must be sufficiently narrow to avoid contact with the teeth of the chain, and should not compress or deform the groove in the sawbar which guides the chain. The opening in the jaws allows horizontal attachment or removal of the chainsaw, so that the possible length of the sawbar is not limited by the clearance between the clamp and the ground. The bolts 168 are tightened to securely grip the sawbar between the bolts and the pad, while avoiding the teeth in the cutting chain and the guiding groove in the sawbar. To the front and rear ends of the carriage the ends of the chain are attached (not shown), and to the bottom edge of the carriage the throttle actuator is pivotally attached (see FIG. 7).

The bar clamp 148 serves to clamp the sawbar in an operative position. The drawings show the operative position of the preferred embodiment as vertical, because the setworks require the orientation of the sawbar to be generally vertical. Alternative setworks that adjust the log vertically rather than horizontally will require that the position of the sawbar be horizontal.

In the preferred embodiment, four shouldered wheels 150 are attached to the carriage plate 146, two on the front end and two on the rear end. The carriage wheels are suitably journalled and freely rotatable. The wheels serve to allow and control the movement of the carriage along the track, improving the accuracy of cuts made by the sawmill, with their shoulders helping to keep the saw accurately aligned, and limiting lateral movements that would take the carriage off the track.

Figure 6:
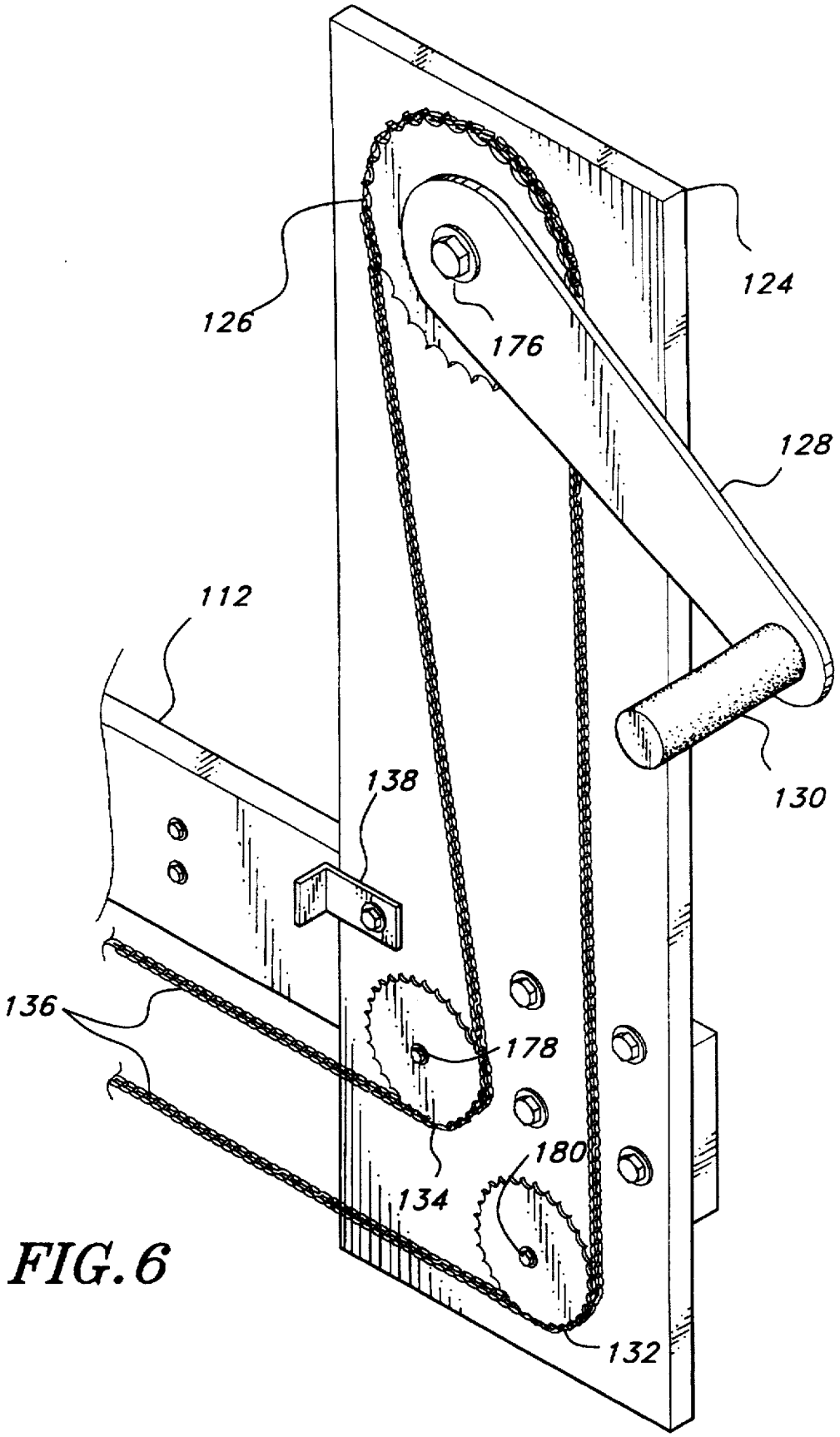
FIG. 6 is a perspective detail view of the means for moving the carriage along the track.

FIG. 6 shows the post 124 and its attached sprocket wheels in greater detail. The drive sprocket wheel 126 is retained at its center to the crank 128 and the post by bolt 176. The middle idler sprocket wheel 134 is retained at its center to the post by bolt 178, and the front idler sprocket wheel 132 is so retained by bolt 180.

Figure 7:
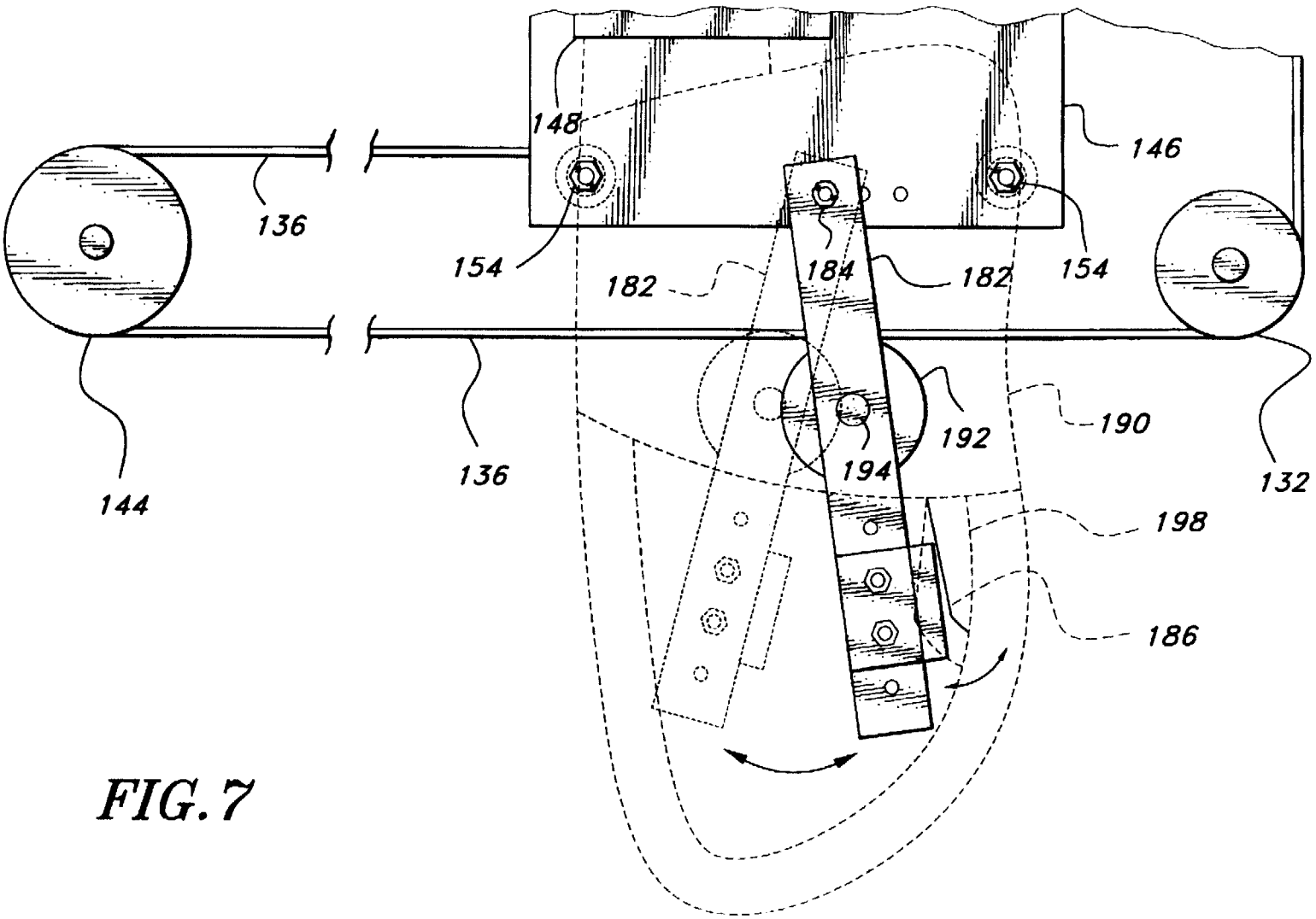
FIG. 7 is an environmental left side elevational view of the throttle actuator.

The throttle actuator shown in FIG. 7 has an arm 182 pivotally attached at its top end to the carriage plate 146 by bolt 184. It is of sufficient length to allow an adjustable trigger plate 186, attached to its lower end, to contact and operate the throttle of a chainsaw, when in a first position indicated by solid lines. Intermediate its pivotal attachment to the carriage plate 120 and its attachment to the trigger plate 186, arm 182 has an idler sprocket wheel 192 that rotates on pivot 194 and meshes with chain 136 as it passes under the carriage. The idler sprocket wheel is suitably journalled and rotatable, with its rotatability controlled by an adjustable friction device (not shown in the drawings), which may be a spring or fiber washer. The carriage and the portion of the carriage movement means chain that passes under the carriage move in opposite directions. The throttle actuator arm, being pivotally attached to the carriage, is caused to swing in the opposite direction that the carriage moves, as the lower part of the chain engages the idler sprocket wheel, thereby operating the chainsaw throttle with the throttle plate. As the carriage advances to cut lumber, the throttle is fully depressed for full power, and as the carriage returns in the opposite direction, the throttle is allowed to return to idle, in a second position indicated by broken lines.

Figure 8:
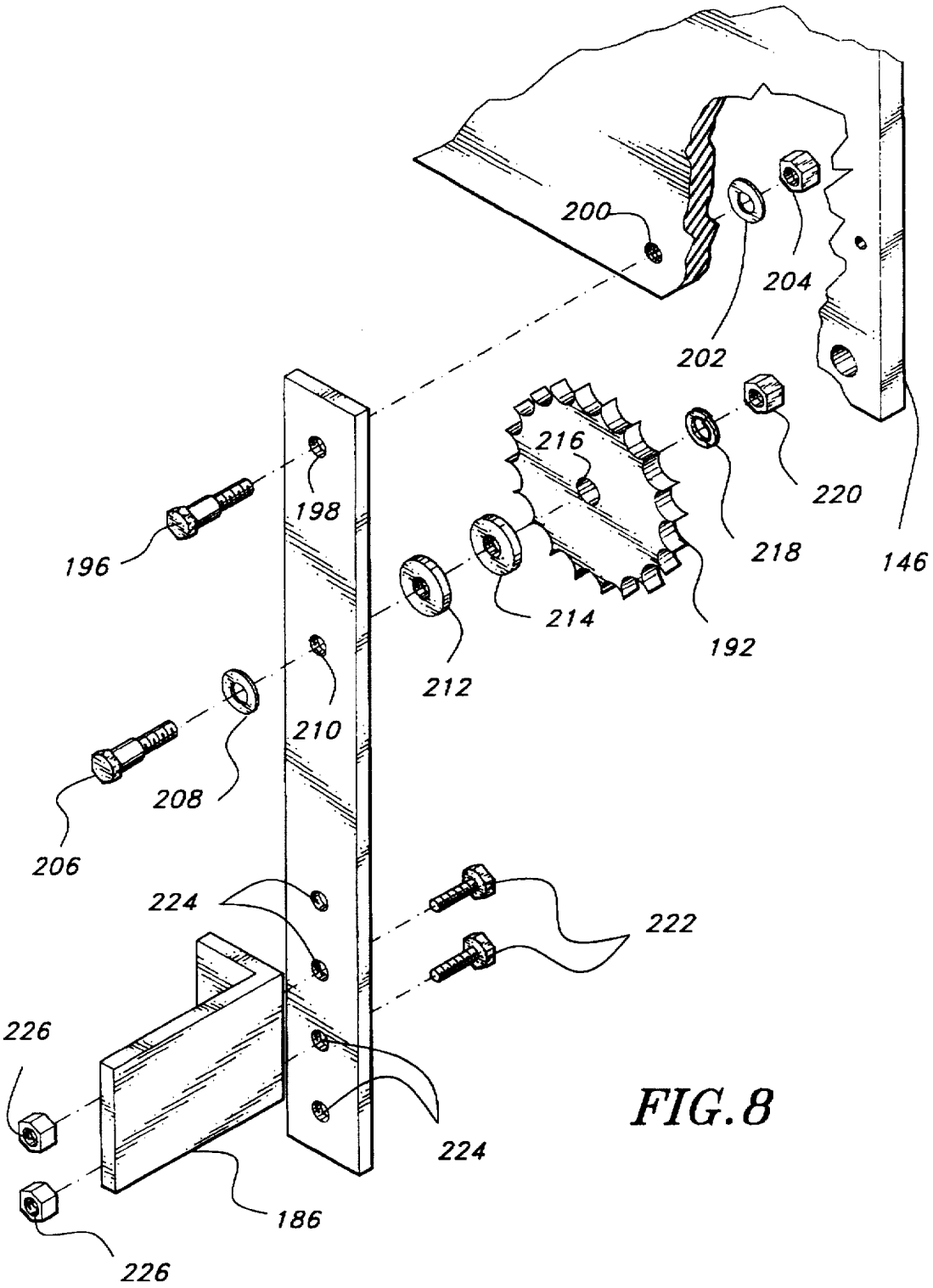
FIG. 8 is an exploded perspective view of the throttle actuator.

FIG. 8 is an exploded perspective view of the throttle actuator, showing the arm 182 pivotally attached to the carriage plate 146 (part of which is broken away in the drawing), by a bolt 196 that passes through a hole 198 in the arm, a hole 200 in the plate, a washer 202, and a nut 204 that secures the threaded end of the bolt. Idler sprocket wheel 192 is pivotally retained on the arm by a bolt 206 that passes through a first metal washer 208, a hole in the arm 210, fiber or spring washers 212 and 214 (one of which may be omitted), a hole in the center of the idler sprocket wheel 216, a second metal washer 218, and a nut that secures the threaded end of the bolt. The trigger plate 186 is retained on the arm by a pair of bolts 222, that pass through an adjacent pair of holes selected from a plurality of holes 224 that are evenly spaced and aligned in the bottom end of the arm, then pass through a pair of holes (not shown) in the trigger plate, with the bolt being secured by nuts 226.

Additionally, there may be a secondary throttle actuator attached to a side of the frame or track, to allow full manual control of the speed of the chain saw at any position (not shown).

Figure 9:
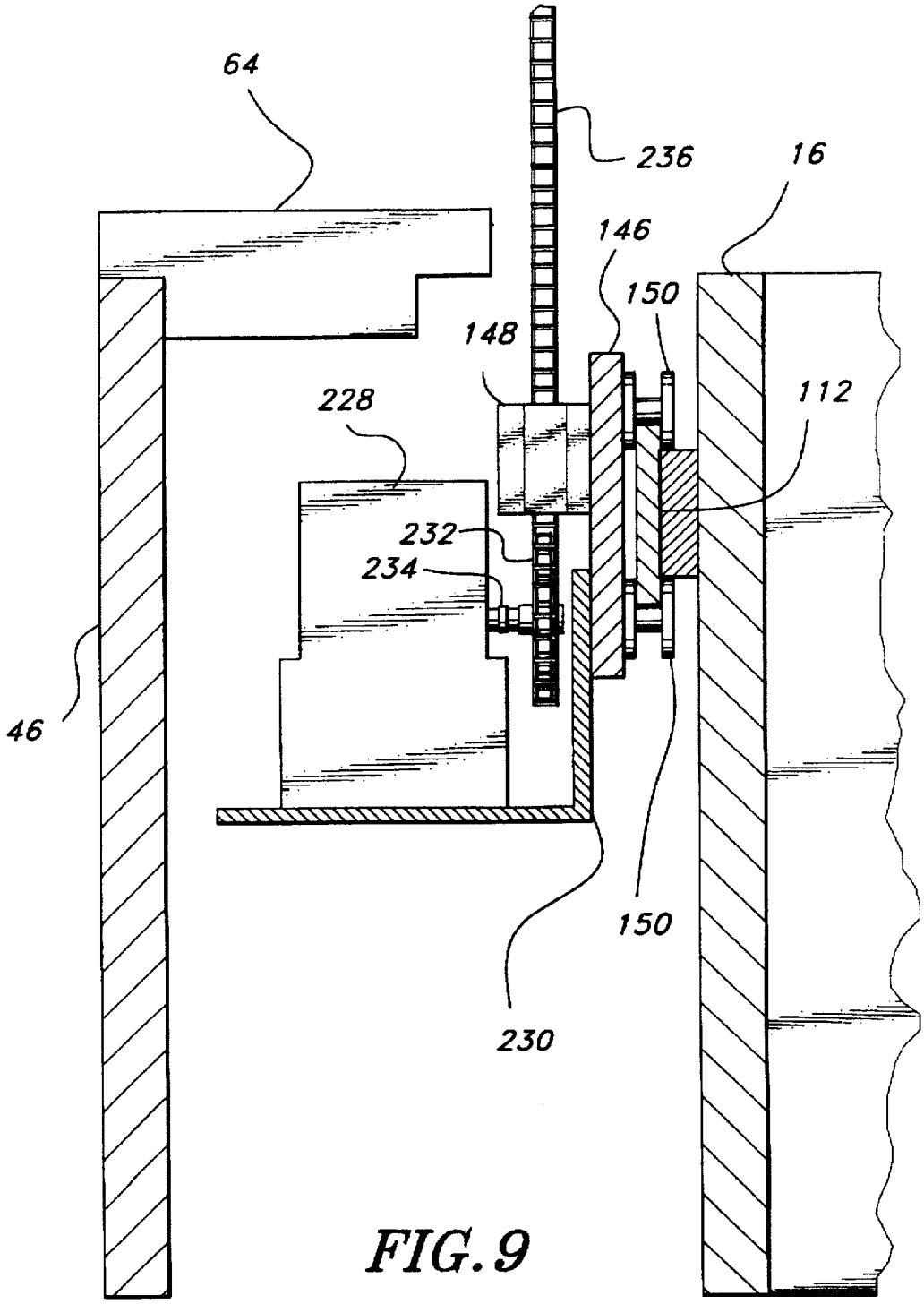
FIG. 9 is a front elevational view of the carriage, with a bracket supporting an alternative engine or motor.

FIG. 9 is a front elevational view of the carriage, with an attached bracket 230 for the support of an alternative engine or electric motor 228, used to power a sawbar and cutting chain held in bar clamp 148. As the power requirements of an automated sawmill differ from those of a conventional chainsaw used by itself, substitution of engines or motors more suited to the demands of the former would give better fuel consumption, less noise, and longer engine or motor life, compared to a conventional chainsaw engine or motor. Bracket 230 is releasably attached to the carriage plate 146 by bolts (not shown) and the engine or motor 228 is releasably attached to the bracket. Drive sprocket wheel 232, attached to the drive shaft 234 of the engine or motor, actively engages the cutting chain 236 to operate it.

Optionally, if the chain saw is powered by an internal combustion engine, a hood may be attached to the engine to redirect the exhaust to blow off sawdust, so as to prevent fires (not shown).

The present invention provides a relatively simple, but extremely versatile and portable sawmill, which can readily be operated by one person. It is particularly suitable for use by "do-it-yourselfers", who can use the invention to saw boards, timbers, clapboards, shingles, decorative posts, etc. The present sawmill thus enables a single person to do what would otherwise require the assistance of several people and more sophisticated equipment. The sawmill's design enables it to be manufactured from extremely sturdy, but reasonably inexpensive materials, and permits various types and sizes of chainsaws to be supported directly on the carriage.

It is to be understood that the present invention is not limited to the embodiments described above, but encompasses any and all embodiments within the scope of the following claims.

I claim:

1. A device for holding and moving a chainsaw along a linear path comprising:

a track having upper and lower travel edges;

means for removably mounting said track to a support structure;

a carriage having upper and lower grooved wheels engaging respective said upper and lower travel edges of said track;

a first post attached to a first end of said track and a second post attached to a second end of said track, said first post having a plurality of gears rotatable mounted thereon, said second post having at least one gear rotatable mounted thereon;

a handle attached to one of said plurality of gears on said first post;

a chain operatively coupled to said carriage and cooperatively engaging said plurality of gears on said first post and said at least one gear on said second post, whereby upon rotation of said handle, said chain is moved about all of said gears to move said carriage along said track;

a sawbar clamp attached to said carriage for mounting the chainsaw; and a throttle actuator for actuating the chainsaw responsive to the movement of said carriage, said throttle actuator including an arm pivotally attached at one end thereof to said carriage, a gear rotatable attached to said arm and cooperatively engaging said chain, and a plate attached to an opposite end of said arm, said plate engaging and actuating a throttle of the chainsaw when the chain moves in a first direction, and releases the throttle when the chain moves in a second direction.

* * * * *